US008369758B2

(12) United States Patent
Okamoto et al.

(10) Patent No.: US 8,369,758 B2
(45) Date of Patent: Feb. 5, 2013

(54) IMAGE FORMING APPARATUS INCLUDING A REAR-END HOLDING MEMBER

(75) Inventors: Tetsuji Okamoto, Ebina (JP); Masahiro Sato, Ebina (JP); Atsushi Ogihara, Ebina (JP); Junichi Murakami, Ebina (JP); Koichi Watanabe, Ebina (JP); Shuichi Nishide, Ebina (JP); Atsuyuki Kitamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 12/870,438

(22) Filed: Aug. 27, 2010

(65) Prior Publication Data

US 2011/0236081 A1 Sep. 29, 2011

(30) Foreign Application Priority Data

Mar. 29, 2010 (JP) ..... 2010-076279

(51) Int. Cl.
*G03G 15/01* (2006.01)

(52) U.S. Cl. ..... 399/304

(58) Field of Classification Search ..... 399/303, 399/304, 305; 271/275, 277
See application file for complete search history.

(56) References Cited

U.S. PATENT DOCUMENTS

| | | | | |
|---|---|---|---|---|
| 3,903,795 | A * | 9/1975 | Suzuki | 101/409 |
| 4,161,358 | A * | 7/1979 | Boschet | 399/159 |
| 4,935,776 | A * | 6/1990 | Fukui | 399/31 |
| 5,410,391 | A * | 4/1995 | Imabayashi et al. | 399/318 |
| 6,729,235 | B2 * | 5/2004 | Kerr | 101/415.1 |
| 2011/0318067 | A1 * | 12/2011 | Okamoto et al. | 399/304 |

FOREIGN PATENT DOCUMENTS

JP A-63-293573 11/1988

* cited by examiner

*Primary Examiner* — Robert Beatty
(74) *Attorney, Agent, or Firm* — Oliff & Berridge, PLC

(57) ABSTRACT

An image forming apparatus includes: an image carrier; a transfer member that transfers an image onto a recording medium; a leading-end holding member that holds a leading-end side of the recording medium, which is fed to the transfer member, between the leading-end holding member and an outer circumferential surface of the transfer member, in such a way to restrict displacement of the recording medium and to restrict movement of the recording medium in a direction away from the transfer member; and a rear-end holding member that holds a rear-end side of the recording medium, in the transporting direction thereof, between the rear-end holding member and the outer circumferential surface of the transfer member, in such a way to allow displacement of the recording medium in the transporting direction and to restrict movement of the recording medium in the direction away from the transfer member.

6 Claims, 3 Drawing Sheets

IMAGE FORMING APPARATUS INCLUDING A REAR-END HOLDING MEMBER

CROSS REFERENCE TO RELATED APPLICATIONS

This application is based on and claims priority under 35 USC §119 from Japanese Patent Application No. 2010-076279 filed Mar. 29, 2010.

BACKGROUND

1. Technical Field

The present invention relates to an image forming apparatus.

2. Related Art

As a related art described in a gazette, there is a transfer device that transfers an image carried by an image carrier onto a transfer paper wound around the circumference of a transfer drum.

SUMMARY

According to an aspect of the present invention, there is provided an image forming apparatus including: an image carrier that is rotatably installed and carries an image on an outer circumferential surface of the image carrier; a transfer member that is rotatably installed facing the image carrier, and transfers the image carried on the image carrier onto a recording medium nipped between the transfer member and the image carrier; a leading-end holding member that holds a leading-end side of the recording medium, which is fed to the transfer member, in a transporting direction thereof, between the leading-end holding member and an outer circumferential surface of the transfer member, in such a way to restrict displacement of the recording medium in the transporting direction and to restrict movement of the recording medium in a direction away from the transfer member; and a rear-end holding member that holds a rear-end side of the recording medium held by the leading-end holding member, in the transporting direction thereof, between the rear-end holding member and the outer circumferential surface of the transfer member, in such a way to allow displacement of the recording medium in the transporting direction and to restrict movement of the recording medium in the direction away from the transfer member.

BRIEF DESCRIPTION OF THE DRAWINGS

Exemplary embodiment of the present invention will be described in detail based on the following figures, wherein.

DETAILED DESCRIPTION

Hereinbelow, an exemplary embodiment of the present invention will be described in detail by referring to the accompanying drawings.

<Overall Configuration of Image Forming Apparatus 1>

Figure 1:
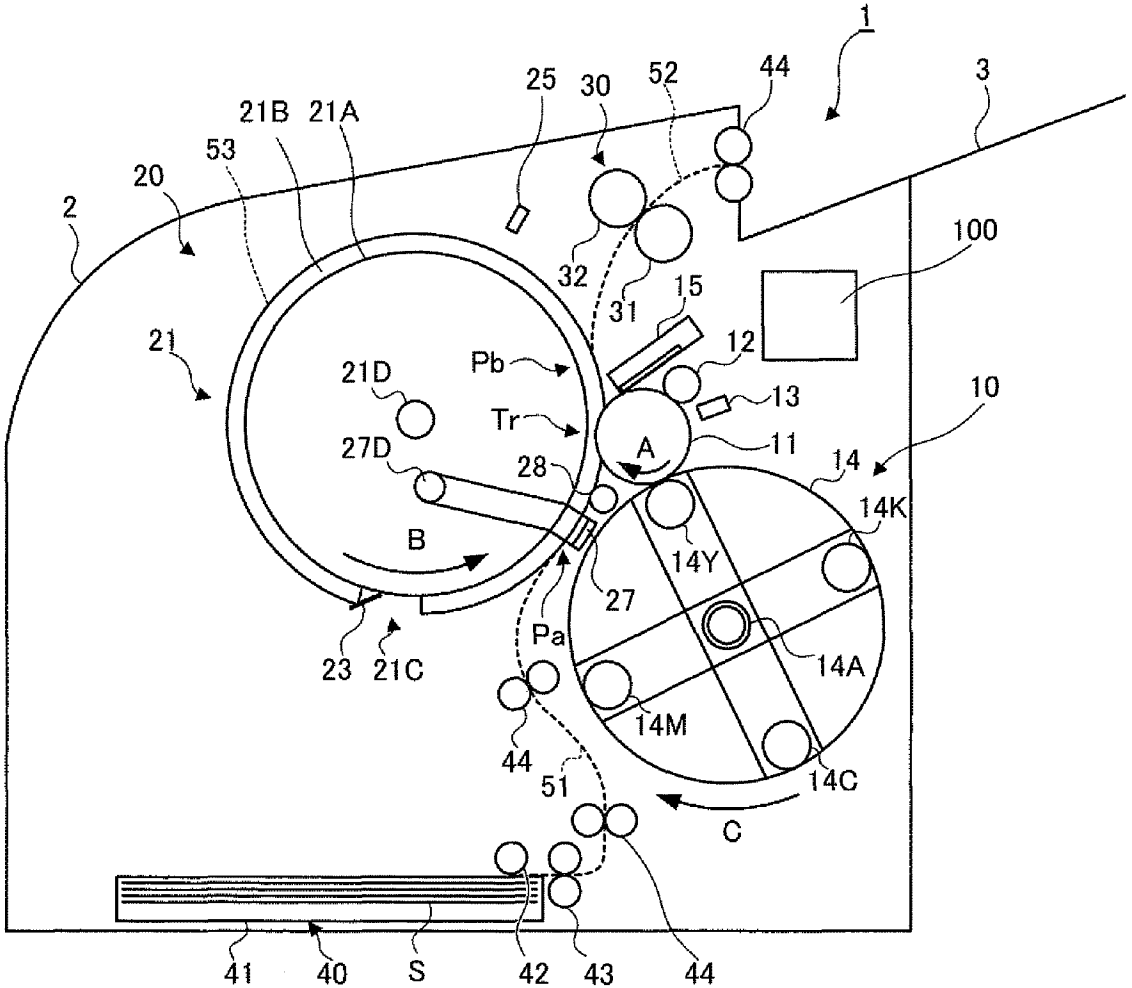
FIG. 1 is a schematic configuration diagram showing an image forming apparatus according to an exemplary embodiment of the present invention.
Figure 2B:
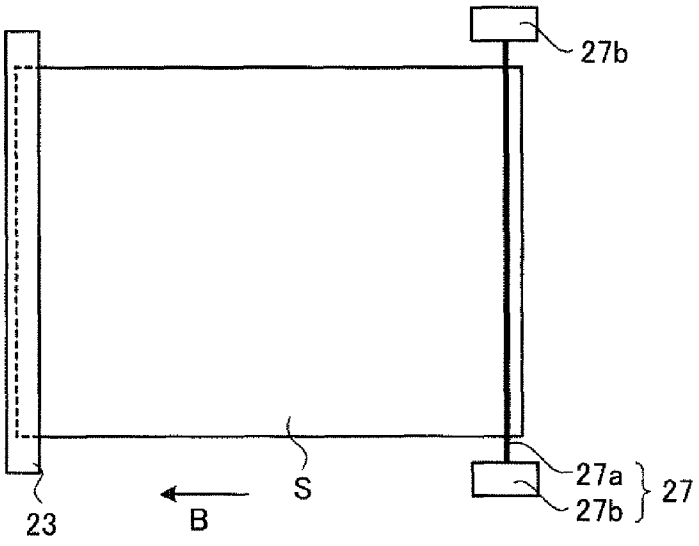
FIGS. 2A to 2C are schematic configuration diagrams of a leading end gripper and a rear end gripper according the exemplary embodiment.
Figure 2A:
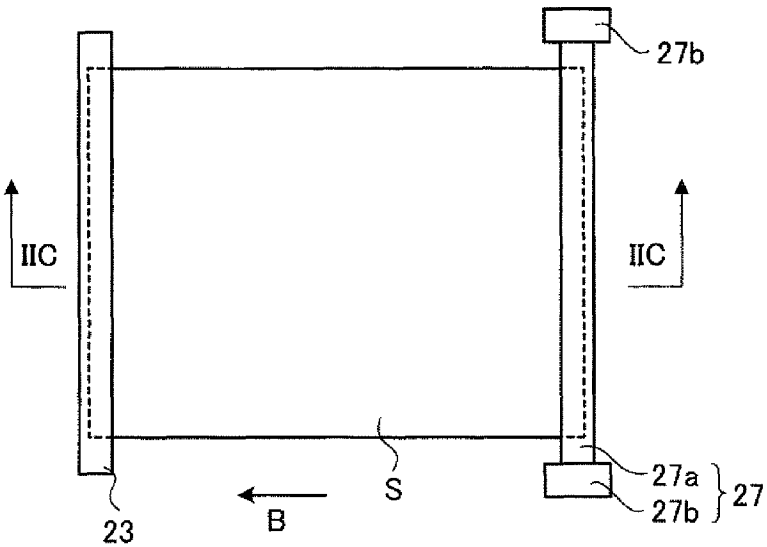
Figure 2C:
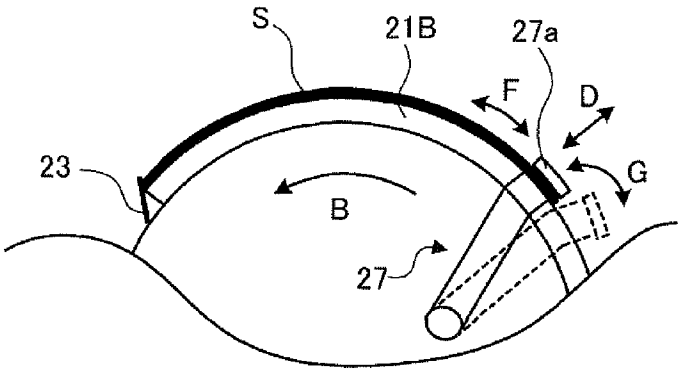

To begin with, each component of an image forming apparatus 1 to which the exemplary embodiment is applied will be described by referring to the FIGS. 1 to 2C. Here, FIG. 1 is a schematic configuration diagram showing the image forming apparatus 1 to which the exemplary embodiment is applied. FIGS. 2A to 2C are schematic configuration diagrams of a leading end gripper 23 and a rear end gripper 27 according to the exemplary embodiment. Specifically, FIGS. 2A and 2B are diagrams of the leading and rear end grippers 23 and 27 to hold a sheet S, seen from an outer side of the image forming apparatus 1, while FIG. 2C is a cross-sectional diagram of the leading and rear end grippers 23 and 27 to hold the sheet S, taken along the arrow IIC-IIC of FIG. 2A.

The image forming apparatus 1 includes: an image forming device 10 to form a toner image; a transfer device 20 to hold the sheet S, which is an example of a recording medium, fed thereto and to transfer the toner image formed by the image forming device 10 onto the held sheet S; a fixing device 30 to fix the toner image on the sheet S released from the transfer device 20; a sheet feeding device 40 to feed and transport sheets S; and a controller 100 to control the whole image forming apparatus 1. Each of these components of the image forming apparatus 1 is housed inside a casing 2. The casing 2 is provided, at its upper portion, with an outputted-sheet loading unit 3 on which the sheets S outputted from the fixing unit 30 are loaded.

<Configuration of Each Component>

First, the image forming device 10 includes: a photoconductive drum 11 as an example of an image carrier; a charging device 12 to charge the photoconductive drum 11; an exposure device 13 to expose the photoconductive drum 11 thus charged; a rotary developing device 14 to develop an electrostatic latent image by use of a developer; and a cleaning device 15 to clean the developer left on the photoconductive drum 11.

The photoconductive drum 11 includes a photoconductive layer (not illustrated) having a negative charge polarity on its surface. Moreover, the photoconductive drum 11 is mounted rotatably in the direction of an arrow A. The charging device 12, the exposure device 13, the rotary developing device 14, and the cleaning device 15 are arranged around the photoconductive drum 11 in this order in the direction of the arrow A. Here, the outer diameter of the photoconductive drum 11 is 30 mm, for example.

In the present exemplary embodiment, the charging device 12 is a discharge device of a contact roller type and is configured to charge the photoconductive drum 11 while rotating together with the photoconductive drum 11.

The exposure device 13 is configured to form an electrostatic latent image by irradiating the charged surface of the photoconductive drum 11 with light. In the present exemplary embodiment, the exposure device 13 includes plural aligned LEDs (not illustrated).

The rotary developing device 14 includes a rotary shaft 14A as well as developing units 14Y, 14M, 14C, and 14K of respective colors of yellow (Y), magenta (M), cyan (C), and black (K), which are arranged around the rotary shaft 14A. Moreover, the rotary developing device 14 is configured to rotate about the rotary shaft 14A in the direction of an arrow C and to stop at such a position that any one of the developing units faces the photoconductive drum 11. The rotary developing device 14 is also configured to develop, with a toner, an electrostatic latent image formed on the photoconductive drum 11 by the exposure device 13. Note that the outer diameter of the rotary developing device 14 is 100 mm, for example.

The developing units 14Y, 14M, 14C, and 14K each include therein a two-component developer containing a toner of its corresponding color and carrier. Here, although a two-component developer is used in the present exemplary embodiment, a one-component developer may be used instead. In the following description, the two-component developer will simply be called a developer.

The cleaning device 15 is configured to remove the developer left on the surface of the photoconductive drum 11 as well as other deposits than the developer on the surface. The cleaning device 15 of the present exemplary embodiment is a blade-type cleaner.

Next, the transfer device 20 will be described. The transfer device 20 is an example of a transfer member and faces the photoconductive drum 11. Moreover, the transfer device 20 is placed rotatably about a rotary shaft 21D. The transfer device 20 includes: a transfer drum 21 to transfer the toner image on the photoconductive drum 11 onto the sheet S; a leading end gripper 23 to grip a leading end portion of the sheet S on the transfer drum 21; a rear end gripper 27 to hold a rear end portion of the sheet S on the transfer drum 21; a phase sensor 25 to detect the phase of the transfer drum 21 rotating; and a sheet stretching member 28 to stretch the sheet S on the transfer drum 21.

The transfer drum 21 includes a drum-shaped base 21A and an elastic layer 21B formed on an outer circumferential surface of the base 21A. Note that the elastic layer 21B is designed not to cover a part, of the outer circumferential surface of the base 21A, extending in the axial direction of the base 21A. This part is referred to as an exposed portion 21C through which the base 21A is exposed.

The transfer drum 21 is provided to rotate in the direction of an arrow B in synchronization with the rotation of the photoconductive drum 11, in a state where a nip is formed between the transfer drum 21 and the photoconductive drum 11 by an elastic deformation of the elastic layer 21B.

The base 21A in the present exemplary embodiment is a conductive hollow tube, specifically, a metal hollow tube. The elastic layer 21B is a semiconductive elastic member, specifically, a polyurethane elastic member.

Here, the base 21A is configured such that a transfer bias formed of a voltage of a polarity opposite to that of a toner is applied to the base 21A from a high voltage power supply (not illustrated). That is, the base 21A is configured such that a toner forming the toner image on the photoconductive drum 11 is transferred onto the sheet S on the elastic layer 21B at a transfer area Tr. In the following description, an area where the photoconductive drum 11 and the transfer drum 21 face each other will be referred to as a transfer area Tr.

The leading end gripper 23 as an example of a leading-end holding member is attached to the exposed portion 21C of the transfer drum 21 and is configured to grip an end portion of the sheet S between itself and the elastic layer 21B. The leading end gripper 23 in the present exemplary embodiment is formed of a plate-shaped member (see FIGS. 2A and 2B), one end portion (located on a downstream side in the direction of the arrow B, i.e., the rotation direction of the transfer drum 21) of which is rotatably fixed to the exposed portion 21C whereas the other end portion (located on an upstream side in the direction of the arrow B, i.e., the rotation direction of the transfer drum 21) of which is a free end. Accordingly, the leading end gripper 23 is made swingable, achieving an open/close structure for the gripping of the sheet S.

In the present exemplary embodiment, as shown in FIGS. 2A to 2C, the leading end gripper 23 is configured to grip the leading end portion of the sheet S in its movement direction (i.e., the leading end portion in the transporting direction, or a left end portion of the sheet S in FIGS. 2A to 2C). The leading end gripper 23 is configured to grip the end portion of the sheet S between itself and the transfer drum 21. The gripping of the end portion of the sheet S in the movement direction by the leading end gripper 23 restricts displacement of the sheet S in the movement direction as well as movement thereof in a direction away from the transfer drum 21.

The rear end gripper 27 as an example of a rear-end holding member is mounted to face the outer circumferential surface of the transfer drum 21. Moreover, the rear end gripper 27 is placed to rotate about a rotary shaft 27D of the rear end gripper 27 so that the rear end gripper 27 may move closer to or away from the surface of the transfer drum 21 (see an arrow G in FIG. 2C). As shown in FIGS. 2A to 2C, the rear end gripper 27 is configured to hold the opposite end portion of the sheet S in the movement direction (i.e., the rear end portion in the transporting direction, or a right end portion of the sheet S in FIGS. 2A to 2C). As will be described later in detail, the holding of the opposite end portion of the sheet S in the movement direction by the rear end gripper 27 allows displacement of the sheet S in the movement direction while restricting movement thereof in the direction away from the transfer drum 21.

In addition, as shown in FIGS. 2A and 2B, the rear end gripper 27 is formed of a sheet restraining portion 27*a* that restrains movement of the sheet S and fixing portions 27*b* which fix both ends of the sheet restraining portion 27*a*. Moreover, the fixing portions 27*b* are connected rotatably to the rotary shaft 27D of the rear end gripper 27. The rotary shaft 27D of the rear end gripper 27 is placed on the transfer drum 21 at a different position from the rotary shaft 21D of the transfer drum 21. That is, the rotary shaft 27D is placed on the transfer drum 21 at an eccentric position with respect to the transfer drum 21.

The sheet restraining portion 27*a* extends in parallel to the rotary shaft 21D of the transfer drum 21 and is longer than the maximum width of the sheet S usable for the image forming apparatus 1 of the present exemplary embodiment (i.e., the length of the sheet S in a direction parallel to the rotary shaft 21D, the sheet S being placed on the outer circumferential surface of the transfer drum 21).

In addition, the sheet restraining portion 27*a* is formed of a plate-shaped member as shown in FIG. 2A or a narrow line-shaped member as shown in FIG. 2B.

Meanwhile, the fixing portions 27*b* are formed of two block-shaped members provided at both ends of the sheet restraining portion 27*a*, respectively. The fixing portions 27*b* are provided to face each other with a gap therebetween, the gap being greater than the maximum width of the sheet S usable for the image forming apparatus 1.

The phase sensor 25 is placed to face the outer circumferential surface of the transfer drum 21, and is configured to detect a mark (not illustrated) given on the transfer drum 21 to thereby measure the phase of the transfer drum 21 rotating.

In addition, the sheet stretching member 28 is formed of a roll-shaped member and placed upstream of the transfer area Tr in the movement direction of the sheet S and downstream of a later-described sheet-feeding position Pa in the movement direction of the sheet S. Moreover, the sheet stretching member 28 is placed in such a way to move closer to or away from the transfer drum 21 (see an arrow H in FIG. 3C).

The fixing device 30 includes a heating roll 31 having a heater (not illustrated) and rotatably placed, and a press roll 32 with which the heating roll 31 comes into press-contact.

The sheet feeding device 40 includes: a sheet housing portion 41 which houses the sheets S therein and is provided in a lower part of the image forming apparatus 1, specifically, below the transfer drum 21; a pick-up roll 42 that picks up the sheet S from the sheet housing portion 41; a pair of separation rolls 43 that separates closely-overlaid sheets S from each other; and pairs of transporting rolls 44 that transport the sheet S.

Here, in the present exemplary embodiment, there are provided: a feeding path 51 to feed the sheet S from the sheet housing portion 41 to the transfer area Tr; and an output path 52 to output the sheet S through the fixing device 30 to the outputted-sheet loading unit 3 after toner images are transferred onto the sheet S at the transfer area Tr. In the present exemplary embodiment, the sheet S fed to the transfer drum 21 circles while being wound around the transfer drum 21 by the leading and rear end grippers 23 and 27. Such route of the sheet S is referred to as a circling path 53.

In the present exemplary embodiment, the sheet S is fed from the sheet housing portion 41 toward the sheet-feeding position Pa located upstream of the transfer area Tr in the rotation direction of the transfer drum 21. In the present exemplary embodiment, the sheet S is then outputted toward the fixing device 30 from a sheet-outputting position Pb located downstream of the transfer area Tr in the rotation direction of the transfer drum 21.

Meanwhile, the sheet restraining portion 27*a* of the rear end gripper 27 may be small in thickness in its cross-sectional direction (i.e., length in the direction of an arrow D in FIG. 2C). Also, a portion of the sheet restraining portion 27*a* of the rear end gripper 27 which comes into contact with the photoconductive drum 11 may have no corners. These are for reducing the damage on the photoconductive drum 11 caused due to contact between the sheet restraining portion 27*a* and the photoconductive drum 11.

Moreover, the sheet restraining portion 27*a* of the rear end gripper 27 may be small in length in the circumferential direction of the transfer drum 21 (i.e., length along an arrow F in FIG. 2C). This is for avoiding a reduction in area of an image formed on the sheet S.

Furthermore, the sheet restraining portion 27*a* of the rear end gripper 27 may be formed of a material possessing such a property that the sheet S may slide thereon. For example, the sheet restraining portion 27*a* may be made of resin such as polyethylene terephthalate resin, polyimide resin, fluororesin, or the like. Note that in a case where the sheet restraining portion 27*a* has a plate shape as shown in FIG. 2A, a sheet of metal such as SUS may be used with a film of a resin such as PET provided on the side of the sheet where it comes into contact with the photoconductive drum 11. In addition, the sheet restraining portion 27*a* of the rear end gripper 27 may be formed into a film shape, a wire shape, a columnar shape or the like instead.

<Operation of Image Forming Apparatus 1>

Next, an image forming process in the image forming apparatus 1 will be described by referring to FIGS. 1 to 3D. Here, FIGS. 3A to 3D are conceptual diagrams to describe the actions of the leading and rear end grippers 23 and 27 in the image forming process.

Firstly, a color reflected light image of an original obtained by scanning the original by an original scanning device (not illustrated), or color image data formed by a personal computer (not illustrated) is inputted to an image signal processing device (not illustrated) as R (red) G (green) B (blue) data, for example, and then subjected to a predetermined image processing.

The image data having undergone the image processing is converted into gradation data of four colors of yellow (Y), magenta (M), cyan (C), and black (K), and then outputted to the exposure device 13.

Figure 3A:
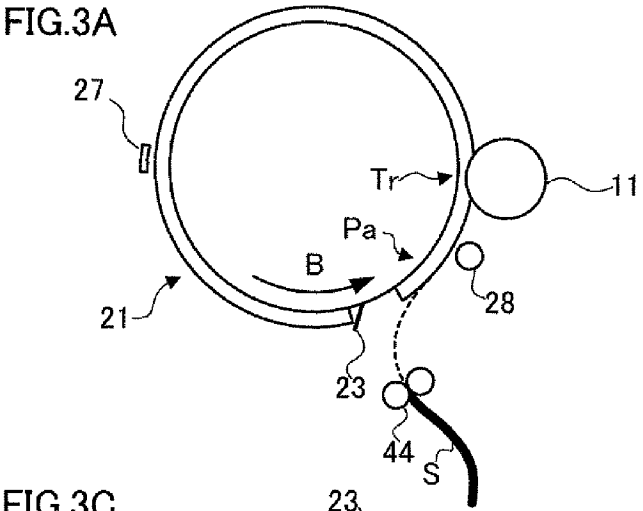
FIGS. 3A to 3D are diagrams showing the actions of the rear end gripper according the exemplary embodiment and of peripheral components thereof.

Thereafter, as the image forming operation starts, the photoconductive drum 11 and the transfer drum 21 start rotating in synchronization with each other as shown in FIG. 3A. Then, after the photoconductive layer of the rotating photoconductive drum 11 is charged by the charging device 12, an electrostatic latent image of a first color (e.g., yellow) corresponding to the image information is formed on the photoconductive layer by the exposure device 13. As the transfer drum 21 starts to rotate, the phase sensor 25 performs measurement of the phase of the transfer drum 21.

Note that in this event, the leading end gripper 23 provided to the transfer drum 21 is open whereas the rear end gripper 27 is at a position close to the transfer drum 21 with no sheet S set thereon. The sheet stretching member 28 is also at a position close to the transfer drum 21.

Meanwhile, the rotary developing device 14 rotates and stops at such a position in advance that one of the developing units which contains a toner of a corresponding color to an electrostatic latent image to be formed on the photoconductive drum 11 (e.g., the yellow developing unit 14Y in a case of yellow) may be placed at the position to face the photoconductive drum 11.

Then, the electrostatic latent image on the photoconductive drum 11 is developed by the developing unit 14Y for example, whereby a toner image is formed on the photoconductive drum 11. Along with the rotation of the photoconductive drum 11, the toner image (in this case, a yellow toner image) is sent toward the transfer area Tr facing the transfer device 20.

The sheet S is fed in response to the start of the image forming operation. Specifically, the sheet S picked up from the sheet housing portion 41 by use of the pick-up roll 42 passes through the separation rolls 43 and is transported to the feeding path 51 by use of the transporting rolls 44. In this event, control is performed on that transportation on the basis of the phase of the transfer drum 21 acquired from the phase sensor 25 so that the sheet S may reach the sheet-feeding position Pa at the same timing as when the leading end gripper 23 reaches the sheet-feeding position Pa.

Figure 3B:
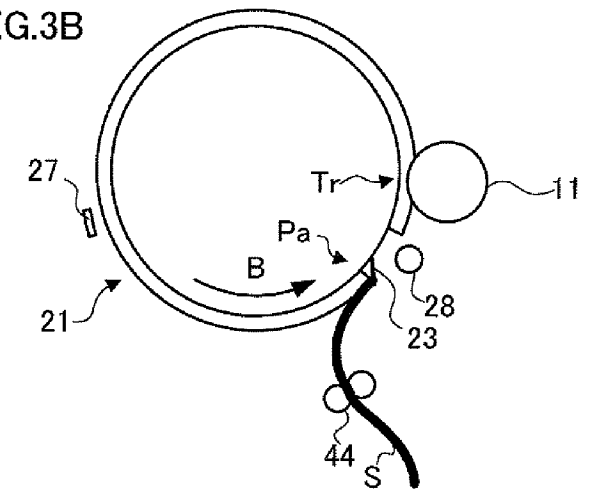

As shown in FIG. 3B, the leading end gripper 23 switches its posture from the open to closed posture at the same timing as when the leading end portion of the sheet S in the movement direction reaches the sheet-feeding position Pa. By this operation, the leading end portion of the sheet S in the movement direction is gripped between the elastic layer 21B and the free end side of the leading end gripper 23. Note that in this event, the rear end gripper 27 is still at the same position close to the transfer drum 21 as shown in FIG. 3A. The sheet stretching member 28 is at a position close to the transfer drum 21.

The leading end gripper 23 then passes the transfer area Tr while gripping the sheet S.

Figure 3C:
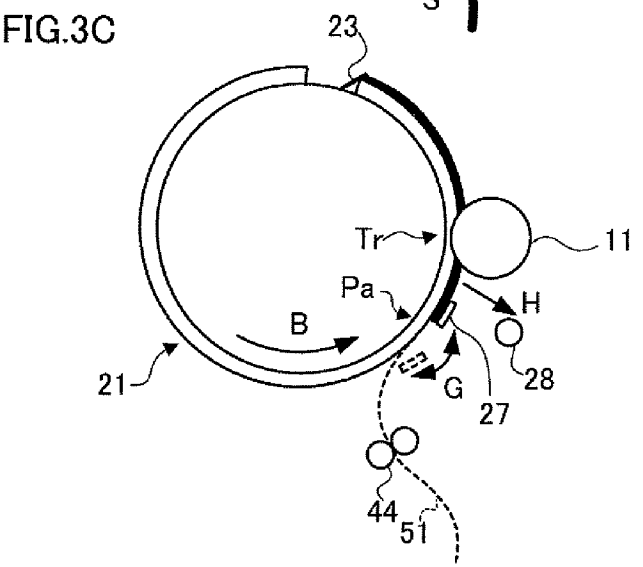

As shown in FIG. 3C, the sheet S having passed the transfer area Tr while being gripped by the leading end gripper 23 is wound around the transfer drum 21 while maintaining the gripped state with the leading end gripper 23 and is transported through the circling path 53. The sheet S gripped by the leading end gripper 23 is pressed against the transfer drum 21 by the sheet stretching member 28 placed upstream of the transfer area Tr in the movement direction of the sheet S. This allows the sheet S to be transported while sticking to the transfer drum 21.

Subsequently, upon receipt of a signal regarding the phase of the transfer drum 21 measured by the phase sensor 25, the controller 100 gives an instruction to the rear end gripper 27. Having received the instruction, the rear end gripper 27 rotates about the rotary shaft 27D of the rear end gripper 27 in the opposite direction to the rotation direction (the direction of the arrow B) of the transfer drum 21, when the rear end portion of the sheet S in the movement direction reaches the vicinity of the sheet stretching member 28. This allows the rear end gripper 27 to be once placed away from the transfer drum 21 (see the rear end gripper 27 depicted with a broken line in FIG. 2C). This also allows the rear end gripper 27 to be placed upstream, in the rotation direction (the direction of the arrow B) of the transfer drum 21, of the position where the rear end portion of the sheet S in the movement direction is placed.

The rear end gripper 27 rotates about the rotary shaft 27D thereof in the opposite direction to the above-described direction, i.e., in the rotation direction of the transfer drum 21 (the direction of the arrow B), after the rear end portion of the sheet S in the movement direction reaches the sheet-feeding position Pa and before the rear end gripper 27 reaches the sheet stretching member 28. Consequently, the rear end gripper 27 moves closer to the transfer drum 21 and holds the rear end portion of the sheet S in the movement direction (see the rear end gripper 27 depicted with a solid line in FIG. 2C).

After the rear end gripper 27 succeeds in holding the sheet S, the sheet stretching member 28 moves away from the transfer drum 21 (see the arrow H). The rear end gripper 27 circles along with the rotation of the transfer drum 21 while holding the rear end portion of the sheet S in the movement direction, the sheet S being wound around the transfer drum 21. In other words, along with the rotation of the transfer drum 21, the sheet S circles with its leading and rear end portions in the movement direction being held by the leading and rear end grippers 23 and 27, respectively (see FIGS. 2A to 2C). Here, when the sheet S passes the transfer area Tr, part of the sheet S between the rear end thereof and the transfer area Tr might rise from the elastic layer 21B. This may possibly bend the sheet S.

Such bend is considered attributable, for example, to the nipping of the sheet S between the transfer drum 21 and the photoconductive drum 11, which causes a difference between a distance from the rotary shaft 21D of the transfer drum 21 to the nipped portion of the sheet S at the transfer area Tr and a distance from the rotary shaft 21D to the un-nipped portion of the sheet S placed on the surface of the elastic layer 21B. Here, the sheet S may sometimes be folded when passing the transfer area Tr due to the bend of the sheet S mentioned above. Moreover, the bend of the sheet S may sometimes cause roughness in a toner image transferred onto the sheet S, wrinkles on the sheet S, displacement of the sheet S on the transfer drum 21, and so forth. The same applies to the second and subsequent colors.

Now, by referring to FIGS. 2A to 2C, description will be given of the relationship between the rear end gripper 27 circling along with the rotation of the transfer drum 21, and the rear end portion of the sheet S in the movement direction.

First, the distance between the rear end gripper 27 and the surface of the elastic layer 21B, more specifically, the distance between the sheet restraining portion 27*a* of the rear end gripper 27 and the elastic layer 21B remains unchanged even when the rear end gripper 27 circles and the transfer drum 21 rotates. Hence, to hold the sheet S between the rear end gripper 27 and the elastic layer 21B is to restrict movement of the sheet S in the direction of the arrow D in FIG. 2C.

In the instance described here, the distance between the sheet restraining portion 27*a* of the rear end gripper 27 and the elastic layer 21B is substantially equal to the thickness of the sheet S. For this reason, by holding the sheet S between the sheet restraining portion 27*a* of the rear end gripper 27 and the elastic layer 21B, the rear end portion of the sheet S in the movement direction is prevented from being detached from the elastic layer 21B. Note that in this instance, in comparison the force of the rear end gripper 27 to hold the sheet S to the force of the leading end gripper 23 to grip the sheet S, the latter is larger.

Here, the distance substantially equal to the thickness of the sheet S in the present exemplary embodiment is such a distance that, in a state where the sheet S is sandwiched between the sheet restraining portion 27*a* and the elastic layer 21B with this distance therebetween, the sheet S is prevented from being detached from the elastic layer 21B in a direction away therefrom and still made movable along the elastic layer 21B. The distance substantially equal to the thickness of the sheet S in the present exemplary embodiment includes a distance equal to the thickness of the sheet S.

To describe in detail the rear end gripper 27 of this instance, the distance between the sheet restraining portion 27*a* of the rear end gripper 27 and the elastic layer 21B is greater than the thickness of the sheet S. Thus, a gap is formed between the sheet S and the surface of the sheet restraining portion 27*a* of the rear end gripper 27 which faces the elastic layer 21B. The formation of this gap allows the movement of the sheet S along the surface of the elastic layer 21B, i.e., in a direction indicated by the arrow F. In other words, a rear end side of the sheet S in the movement direction which is held by the rear end gripper 27 is in a flexible condition. Then, bend of the sheet S caused at the transfer area Tr as mentioned above may be eliminated by allowing the sheet S to move along the surface of the elastic layer 21B through the gap between the sheet restraining portion 27*a* of the rear end gripper 27 and the elastic layer 21B. In sum, the rear end gripper 27 may absorb bend of the sheet S.

Figure 3D:
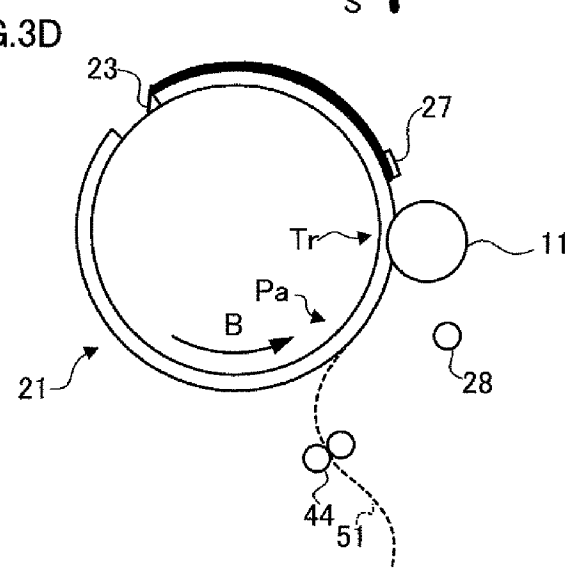

Now, return to FIGS. 3A to 3D again. The rear end gripper 27 passes the transfer area Tr while holding the sheet S as shown in FIG. 3D.

The first (e.g., yellow) toner image formed on the photoconductive drum 11 is transferred onto the sheet S on the transfer drum 21 at the transfer area Tr where the photoconductive drum 11 and the transfer drum 21 face each other. Note that the toner left on the photoconductive drum 11 after the transfer is removed by the cleaning device 15.

In a case of forming a multi-layered image, the formation of a latent image, development of the latent image, and the transfer of the developed image are repeated by following the aforementioned procedure for each of the second and subsequent colors (e.g., magenta, cyan and black). In the formation of a toner image of each color, the rotary developing device 14 rotates so that the corresponding one of the developing units 14M, 14C, and 14K may be placed at the stop position.

During this event, the sheet S circles and is transported through the circling path 53 while being gripped by the leading end gripper 23 on the transfer drum 21 and also held by the rear end gripper 27 between the rear end gripper 27 and the transfer drum 21. Toner images of the second and subsequent colors are sequentially transferred to overlap one another every time the sheet S passes the transfer area Tr. Accordingly, in a case of, for example, full-color image formation, toner images of respective colors of yellow (Y), magenta (M), cyan (C), and black (K) are transferred onto the sheet S on the transfer drum 21 as multiple layers.

When the last (e.g., black) transfer is finished, the gripping of the sheet S by the leading end gripper 23 on the transfer drum 21 is canceled (released). Then, the sheet S having the multi-layered toner images transferred thereon leaves the transfer drum 21, enters the output path 52 from the sheet-outputting position Pb, and thereafter transported to a fixing nip where the heating roll 31 and the press roll 32 constituting the fixing device 30 are in press-contact with each other. The rear end gripper 27 moves away from the transfer drum 21 either before reaching the transfer area Tr or near the sheet-outputting position Pb, so that the sheet S is released.

Thereafter, the sheet S transported to the fixing nip is subjected to fixing by which the toner images held on the sheet S is fixed onto the sheet S by the fixing nip. The sheet S having undergone the fixing is outputted to the outside of the image forming apparatus 1 by the transporting rolls 44 and loaded on the outputted-sheet loading unit 3.

Note that the leading end gripper 23 according to the present exemplary embodiment is a plate-shaped member, but may be formed into a different shape such as a columnar shape or a narrow line shape. In addition, the way of setting the leading end gripper 23 on the exposed portion 21C is not limited to the above exemplary embodiment.

Moreover, the sheet restraining portion 27*a* of the rear end gripper 27 according to the present exemplary embodiment is a plate-shaped member or a narrow line-shaped member, but may be formed into a different shape such as a columnar shape. Furthermore, the number of sheet restraining portions 27*a* is not limited to one, and the sheet restraining portion 27*a* may be plural narrow line-shaped members, for example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that is rotatably installed and carries an image on an outer circumferential surface of the image carrier;

a transfer member that is rotatably installed facing the image carrier, and transfers the image carried on the image carrier onto a recording medium nipped between the transfer member and the image carrier;

a leading-end holding member that holds a leading-end side of the recording medium, which is fed to the transfer member, in a transporting direction thereof, between the leading-end holding member and an outer circumferential surface of the transfer member, in such a way to restrict displacement of the recording medium in the transporting direction and to restrict movement of the recording medium in a direction away from the transfer member; and a rear-end holding member that holds a rear-end side of the recording medium held by the leading-end holding member, in the transporting direction thereof, between the rear-end holding member and the outer circumferential surface of the transfer member, such that it would not hinder displacement of the recording medium in the transporting direction and to restrict movement of the recording medium in the direction away from the transfer member.

2. The image forming apparatus according to claim 1, wherein the rear-end holding member is placed in such a way to form a gap between the rear-end holding member and the recording medium.

3. The image forming apparatus according to claim 1, wherein the rear-end holding member includes any one of a film and a wire.

4. The image forming apparatus according to claim 2, wherein the rear-end holding member includes any one of a film and a wire.

5. An image forming apparatus comprising:

an image carrier that is rotatably installed and carries an image on an outer circumferential surface of the image carrier;

a transfer member that is rotatably installed, facing the image carrier, and transfers the image carried on the image carrier onto a recording medium nipped between the transfer member and the image carrier;

a leading-end holding member that holds a leading-end side of the recording medium, which is fed to the transfer member, in a transporting direction thereof, between the leading-end holding member and an outer circumferential surface of the transfer member; and a rear-end holding member that holds a rear-end side of the recording medium held by the leading-end holding member, in the transporting direction thereof, such that it would not hinder absorption of bend of the recording medium caused when the recording medium is transported.

6. The image forming apparatus according to claim 5, wherein the rear-end holding member absorbs bend of the recording medium caused on the rear-end side, in the transportation direction, of the recording medium downstream of a transfer area formed with the image carrier and the transfer member.

* * * * *